United States Patent [19]

Kopp

[11] Patent Number: 4,590,677

[45] Date of Patent: May 27, 1986

[54] ALIGNMENT GAUGE FOR SCRIBER TOOL

[76] Inventor: Paul J. Kopp, 8071 Lamplight Dr., Jenison, Mich. 49428

[21] Appl. No.: 669,386

[22] Filed: Nov. 8, 1984

[51] Int. Cl.[4] ..... B43L 13/00

[52] U.S. Cl. ..... 33/42; 33/185 R; 33/32.1

[58] Field of Search ..... 33/42, 32 R, 32 C, 18 R, 33/185 R, 180 R

[56] References Cited

U.S. PATENT DOCUMENTS

| | | | |
|---|---|---|---|
| 809,037 | 1/1906 | Walker | 33/185 R |
| 1,465,230 | 8/1923 | Nikander | 33/42 |
| 1,901,242 | 3/1933 | Hogg | 33/185 R |
| 2,000,476 | 5/1935 | Schmidt | 33/185 R |
| 2,010,215 | 8/1935 | Breitenstein | 33/185 R |
| 2,287,601 | 6/1942 | Callaghan | 33/42 |
| 2,409,106 | 10/1946 | Connelly | 33/42 |
| 2,509,876 | 5/1950 | Neiss | 33/42 |
| 2,587,799 | 3/1952 | Winter | 33/42 |
| 2,619,173 | 11/1952 | Crain | 33/180 R |
| 2,646,624 | 7/1953 | Ruby et al. | 33/42 |
| 2,796,665 | 6/1957 | Cossock | 33/23 |
| 2,845,716 | 8/1958 | Culver et al. | 33/180 R |
| 3,113,382 | 12/1963 | Lursen | 33/42 |
| 3,280,468 | 10/1966 | Rangus | 33/185 R |
| 3,293,754 | 12/1966 | Lenzini et al. | 33/42 |
| 3,626,595 | 12/1971 | Hulen | 33/32 B |
| 3,643,335 | 2/1972 | Smith | 33/42 |
| 3,744,141 | 7/1973 | Strickland, Sr. | 33/180 R |
| 3,871,100 | 3/1975 | Hildebrandt | 33/42 |
| 3,875,664 | 4/1975 | Diner | 33/42 |
| 3,888,477 | 6/1975 | Tate | 33/180 R |
| 4,022,260 | 5/1977 | Wilson | 33/42 |

*Primary Examiner*—Willis Little

*Attorney, Agent, or Firm*—Price, Heneveld, Huizenga & Cooper

[57] ABSTRACT

An alignment gauge and method of use for aligning a scriber tool, the alignment gauge including a base and a pair of upstanding, at least semi-transparent side walls that extend forward of the front edge of the base. A pair of sight lines extend along the inside surfaces of the side walls in a common plane with the base front edge, and a clamp holds the guide post of the scriber in abutment with the base front edge while the scribing needle is visually aligned with the sight lines.

14 Claims, 5 Drawing Figures

ALIGNMENT GAUGE FOR SCRIBER TOOL

BACKGROUND OF THE INVENTION

The present invention relates to alignment gauges for tools, and in particular to an alignment gauge for use with scriber tools and the like.

Scriber tools or instruments are well known for use in the marking of floor coverings, counter top coverings or the like, such as for example linoleum or Formica brand laminate covering. While such covering material is being installed, a scriber tool is used to inscribe a line on a piece of covering material stock that corresponds to the edge of a section of covering material previously laid. The covering material may then be cut along this line in order to mate with and form a smooth, unnoticeable joint with the previously laid section of material.

A variety of scriber tools are conventionally known, such as those disclosed in U.S. Pat. No. 2,287,601 to Callaghan, issued June 23, 1942; and U.S. Pat. No. 2,409,106 to Connelly, issued Oct. 8, 1946. These scriber tools normally include a guide member that is used as a follower along the edge of the previously positioned covering material while scribing on an overlapping second section. The tool includes a needle that is adjustable relative to the guide member, so that a line will be produced that either corresponds precisely with or alternatively is spaced from the edge of the previously laid section. A spaced line may be preferable, for example, if it is desirable to lay a narrow strip of material between adjacent covering sections that has a contrasting color or pattern to the surrounding material. The covering material may also be cut to have an abutting edge at a slightly acute angle in order to produce an overlap of the adjoining covering sections at their interface. Depending upon the thickness of the covering material, it may be necessary to offset the line slightly from the edge of the mating covering section in order to produce this angle cut.

A problem commonly experienced with such scriber tools is the proper alignment of the scribing needle relative to the guide member. An operator is required to visually line up the scribing needle with the follower surface on the guide member while manually adjusting the relative position of the scribing needle. This alignment process can be difficult and time consuming since it is difficult to visually determine when the scribing needle is precisely aligned with the follower surface. This problem is greatly magnified when the scribing needle is set to accommodate a relatively thick covering material, since the needle is spaced an appreciable distance from the guide member. Further, in situations where the proper position of the needle is to be somewhat offset from the guide member follower surface, it is difficult to determine when the needle is positioned at the correct spacing from the follower surface.

The problems associated with a misaligned scribing needle can be quite severe in that even a slight misalignment of the scribing needle can result in a very noticeable gap between adjoining covering material sections. Since one of the major functions of this type of floor covering or counter top covering is the aesthetically pleasing appearance it presents, such visably noticeable gaps detract seriously from the overall appearance and quality of the covering. Further, even small gaps between sections of covering material can trap dirt particles, which in addition to being unsanitary, further highlight the unpleasant appearance of the improperly joined sections. When a gap is present in material used as a counter top covering in a kitchen or the like, such crevices can trap food or dirt that is both difficult to clean out and may contaminate other food being prepared upon this surface.

Since two of the major desirable traits of such types of covering material is its seamless quality and ease of installation, improper cutting of the material sections due to a misaligned scriber tool severely detracts from the appearance of the overall end product, results in wasted covering material stock and requires tedious and time consuming alignment methods in order to avoid these problems.

SUMMARY OF THE INVENTION

The present invention solves the problems noted above by the provision of an alignment gauge for use with scriber tools that provides for the quick and accurate alignment of the scriber tool. The gauge provides a base upon which the scriber tool is mounted with the guide member abutted against a positioning surface. The gauge includes a pair of sighting elements that are positioned on either side of the scriber tool, and which are both aligned with the positioning surface. With the scriber tool mounted on the gauge, the operator can readily adjust the position of the scriber needle while visually sighting along the sighting elements to quickly and accurately align the needle with the positioning surface and thus with the follower surface on the guide member.

In the preferred embodiment, the gauge provides an apparatus that is inexpensive to manufacture and relatively easy to operate to obtain accurate results. The apparatus is not cumbersome so that an operator can carry the apparatus with him so as to be readily available for use. The apparatus is adaptable to virtually any conventional scriber tool, and can accommodate a wide range of settings.

These and other features, advantages, and objects of the present invention will be further understood and appreciated by those skilled in the art by reference to the following written specification, claims, and appended drawings.

DETAILED DESCRIPTION OF THE PREFERRED EMBODIMENTS

Figure 1:
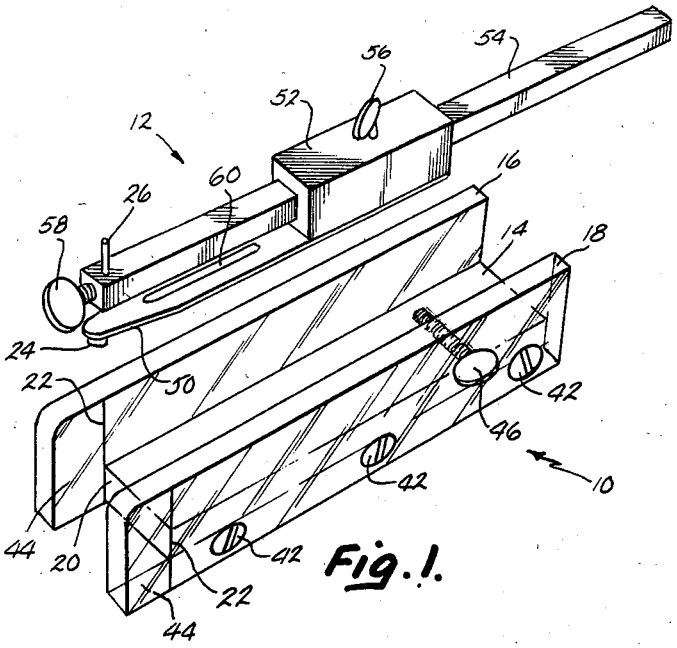
FIG. 1 is a perspective view of an alignment gauge embodying the present invention, shown with a scriber tool prior to being mounted thereon.
Figure 2:
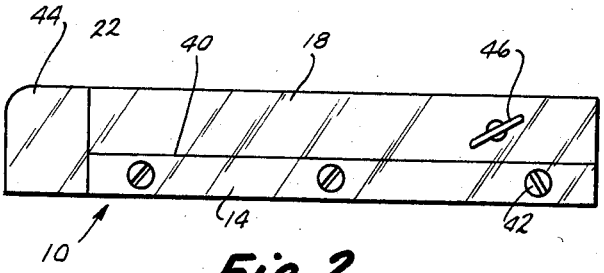
FIG. 2 is a side elevational view of the alignment gauge of FIG. 1.
Figure 3:
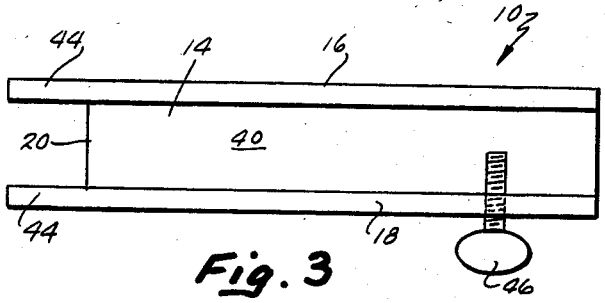
FIG. 3 is a top plan view of the alignment gauge of FIG. 1.

In the preferred embodiment an alignment gauge as shown in FIG. 1 is referenced generally by the numeral 10. Gauge 10 is used with a scriber tool or instrument 12 of conventional design. Gauge 10 includes a bottom wall 14 and a pair of side walls 16 and 18. Bottom wall 14 has a forward edge 20 that is spaced from the forward edges of side walls 16 and 18. On both side walls 16 and 18 are sight lines 22 which are aligned with forward edge 20. Scriber tool 12 includes a guide post 24 and an adjustable scribing needle 26, both of conventional design. With scriber tool 12 mounted on gauge 10 forward edge 20 forms a positioning surface over which guide post 24 hooks and abuts, so that needle 26 may be visually aligned with sight lines 22 in order to properly align scriber tool 12.

More specifically, in reference to the preferred embodiment shown in FIGS. 1–5, bottom wall 14 is an elongated rectangular block that acts as a base for gauge 10. Bottom wall 14 has a smooth, planar upper surface 40 that is sufficiently large to provide a stable support for scriber tool 12. Forward edge 20 is sharply perpendicular to upper surface 40, so as to form a positioning surface or edge against which guide post 24 can squarely abut. Preferably, bottom wall 14 is made from a hard polymeric material, but alternatively bottom wall 14 may be made from any suitable, substantially rigid material that accurately positions forward edge 20 and side walls 16 and 18.

Side walls 16 and 18 are also elongated rectangular blocks upstanding from either side of bottom wall 14. Side walls 16 and 18 are connected to bottom wall 14 by three counter sunk screws 42. Additionally, side walls 16-18 are adhered to bottom wall 14 by a conventional transparent acrylic adhesive. Side walls 16 and 18 have a length greater than that of bottom wall 14, so that each side wall includes a front end 44 that extends past or forward of bottom wall forward edge 20. Front ends 44 project sufficiently far past bottom wall forward edge 20 to provide a medium for carrying sight lines 22. Sight lines 22 are aligned with forward edge 20, so as to extend vertically from and lie in a common plane with forward edge 20. Sight lines 22 are therefore perpendicular to bottom wall top surface 40 and are imprinted on the inside surface of both sides walls 16 and 18.

Preferably, side walls 16 and 18 are formed from blocks of transparent polymeric material, such as the material marketed under the trademark Plexiglass. Side walls 16 and 18 are sufficiently thick so as to be rigid and prevent bending or other distortion of sight lines 22. Although a transparent material is preferred, any suitable material being sufficiently semi-transparent or translucent so as to permit viewing through the sides of side walls 16, 18 in order to discern sight lines 22 and the relative location of scriber needle 26 thereto may be used. Preferably, both side walls 16 and 18 have these semi-transparent properties so that an operator may use gauge 10 by sighting through either side wall 16 or 18. Alternatively, one side wall may be made of an opaque material. In such an alternative embodiment, sight line 22 on the opaque side wall is of a color contrasting with that of the opaque side wall so as to be readily visible through the opposite, semi-transparent side wall. Sight lines 22 are vertical lines inscribed into the inner surface of side walls 16 and 18 and are darkly colored so as to be readily visible.

Threadably received through side wall 18 is a mounting bolt 46. Bolt 46 is spaced toward the rear edge of side wall 18 and is used to mount scriber 12 on gauge 10 during adjustment. Bolt 46 therefore has a blunt engagement end and a flanged head to permit turning bolt 46 by hand.

Scriber tool 12 has an elongated, planar arm or base 50. Guide post 24 operates as an index for tool 12, and arm 50. A side block 52 is connected to the end of arm 50 opposite post 24. An adjustable bar 54 is telescopingly received through side block 52 so as to extend parallel to arm 50. Needle 26 is adjustably received through the forward end of adjustable bar 54 so as to depend toward arm 50. A hand tightenable adjustment bolt 56 selectively fixes bar 54 in side block 52 and a set screw or adjustment bolt 58 holds needle 26 in position with the desired spacing from arm 50. A slot 60 extends along the center line of arm 50 in order to permit needle 26 to slidably extend through arm 50 when needle 26 is positioned closer to slide block 52 than the position of guide post 24. Scriber tool 12 is of any conventional design, such as that disclosed in U.S. Pat. No. 2,287,601 to Callaghan, issued June 23, 1942; and U.S. Pat. No. 2,409,106 to Connelly, issued Oct. 8, 1946, the disclosure of both of which are incorporated herein by reference.

Figure 4:
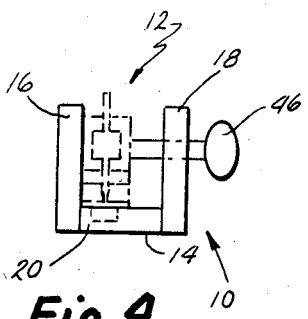
FIG. 4 is a front elevational view of the alignment gauge of FIG. 1, with the scriber tool shown in phantom mounted thereon.
Figure 5:
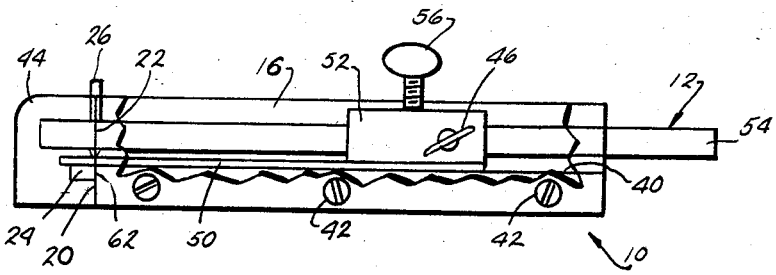
FIG. 5 is a side elevational view of the alignment tool of FIG. 1 partially broken away, shown with the scriber tool mounted and aligned therein.

In certain applications in which scriber tool 12 is used, the rearward surface of guide post 24 forms an edge following surface 62, FIG. 5. In order to adjust the alignment of needle 26, scriber tool 12 is first mounted in alignment gauge 10 as shown in FIG. 5. Arm 50 is rested upon top surface 40 of bottom wall 14. Guide post 24 is hooked over the lip at forward edge 20, with edge following surface 62 tightly abutted against forward edge 20. Mounting bolt 46 is positioned to be adjacent side block 52. As shown in FIG. 4, mounting bolt 46 is tightened in order to clamp side block 52 tightly against side wall 16. With scriber tool 12 thus clamped onto alignment gauge 10, following surface 62 is aligned with sight lines 22 yet adjustable bar 54 is left free to be adjusted.

To align needle 26, the operator loosens scriber adjustment bolt 56 and shifts needle 26 while sighting through either side wall 16 or 18 along sight lines 22. When the operator visually determines that needle 26 has come into alignment along the plane between sight lines 22, adjustment bolt 56 is tightened and needle 26 is thus fixed in alignment with edge following surface 62.

It is to be understood that the above is merely a description of the preferred embodiment and that one skilled in the art would appreciate that various modifications or improvements may be made without departing from the spirit of the invenion disclosed therein. The scope of the protection afforded is to be determined by the claims which follow and the breadth of interpretation which the law allows.

The embodiments of the invention in which an exclusive privilege or property is claimed are as follows:

1. An alignment gauge for accurately adjusting a scriber tool having an index adjustable relative a scribing needle, comprising:

a receipt means for receiving the scriber tool, said receipt means having a lip means for positive receipt of said index, said lip means including a positioning surface for positive engagement with said index; and a sighting element coupled with said lip means, said sighting element being aligned with said positioning surface, whereby said scribing needle can be quickly adjusted.

2. An article as defined in claim 1, wherein:

said sighting element includes a sight line extending generally parallel to said positioning surface.

3. An article as defined in claim 2, further comprising:

a second sighting element aligned with said positioning surface and said sight line, said second sighting element spaced from said sight line sufficient to receive said scribing needle therebetween.

4. An article as defined in claim 2, wherein:

said positioning surface is defined on a base and said sight line is defined on a side wall secured to said base.

5. An article as defined in claim 4, wherein:

said sighting means includes said side wall being at least sufficiently transparent to provide for the visual inspection therethrough of said scribing needle and ascertain the relative location of said scribing needle to said sight line.

6. An article for use in the alignment of a scriber tool having a lower support surface with a guide member depending therefrom and a scribing needle adjustably mounted thereon, said guide member having an edge following surface and said scribing needle being adjustable relative to said edge following surface, said article comprising:

a base having a substantially planar upper surface of sufficient size to stably contact said support surface, said base including a lip defining a positioning surface angled to abut said scriber edge following surface when said scriber is positioned with said scriber support surface in contact with said base upper surface; and at least one sighting element extending from said base generally perpendicular to said base support surface and aligned with said positioning surface, said sighting element being positioned so as to be visible when said scriber guide member is in receipt of said scriber tool, whereby said scriber tool can be positioned on said base with said guide member hooked over said lip and said scriber edge following surface in abutment with said positioning surface, said scribing needle being adjusted into visual alignment with said sighting element.

7. An article as defined in claim 6, wherein:

said sighting element includes a pair of spaced, upstanding side walls connected to said base, at least one of said side walls being at least sufficiently transparent to provide for the visual inspection therethrough of a scriber tool positioned between said side walls and ascertain the relative location of said scribing needle thereof, and a pair of sight lines, each said sight line carried on one of said side walls.

8. An article as defined in claim 7, further comprising:

means for selectively clamping said scriber tool onto said base.

9. An article as defined in claim 6, further comprising:

means for selectively clamping said scriber tool onto said base.

10. An article for use in the alignment of a scriber tool having a lower support surface with a guide member depending therefrom and a scribing needle adjustable mounted thereon, said guide member having an edge following surface and said scribing needle being adjustable relative to said edge following surface, said article comprising: p1 a bottom wall having a substantially planar upper surface;

a pair of upstanding side walls connected to said bottom wall, said side walls being spaced sufficiently to receive said scriber tool therebetween;

said side walls including means for sighting between said side walls along a preselected plane passing between said side walls; and means for positioning said scriber edge following surface in alignment with said preselected plane and maintaining said scriber edge following surface thereat while said scriber needle is adjusted into visual alignment with said sighting means.

11. The article of claim 10, wherein:

said sighting means includes at least one of said side walls being at least sufficiently transparent to provide for the visual inspection therethrough of a scriber tool positioned between said side walls and ascertain the relative location of said scribing needle thereto, and a sight line carried on each of said side walls in alignment with said preselected plane.

12. The article of claim 11, wherein:

both said side walls are at least sufficiently transparent to provide for the visual inspection therethrough of a scriber tool positioned between said side walls and ascertain the relative location of said scribing needle thereto.

13. A method for aligning a scriber tool, said method comprising:

providing a scriber tool having a lower support surface with a guide member depending therefrom and a scribing needle adjustably mounted thereon, said guide member having an edge following surface and said scribing needle being adjustable relative to said edge following surface;

providing an adjustment gauge comprising a base having a substantially planar upper surface of sufficient size to stably contact said scriber support surface, said base including a lip defining a positioning surface angled to about said edge following surface when said scriber tool is positioned with said scriber support surface in contact with said base upper surface, a sighting element extending from said base generally perpendicular to said base support surface and aligned with said positioning surface;

placing said scriber tool on said adjustment gauge with said guide member hooked over said lip with said scriber support surface on said upper surface and said edge following surface in abutment with said positioning surface;

sighting along said sighting element; and adjusting said scribing needle until said needle is visually aligned with said sighting element.

14. The method of claim 13, wherein:

said providing an adjustment gauge step includes providing said adjustment gauge having a pair of spaced, upstanding side walls connected to said base, at least one of said side walls being at least sufficiently transparent to provide for the visual inspection therethrough of said scriber tool when positioned between said side walls and ascertain the relative location of said scribing needle, and said sighting element includes sight lines carried on said sight walls; and said sighting step includes sighting through said semi-transparent side wall along said sight lines.

* * * * *

UNITED STATES PATENT AND TRADEMARK OFFICE

CERTIFICATE OF CORRECTION

PATENT NO. : 4,590,677

DATED : May 27, 1986

INVENTOR(S) : Paul J. Kopp

It is certified that error appears in the above-identified patent and that said Letters Patent is hereby corrected as shown below:

Column 3, line 38:
"sides walls" should be --side walls--

Column 5, Claim 10, line 60:
"adjustable" should be --adjustably--

Column 5, claim 10, line 65:
delete "pl"

Signed and Sealed this

Fourteenth Day of October, 1986

[SEAL]

*Attest:*

DONALD J. QUIGG

*Attesting Officer*

*Commissioner of Patents and Trademarks*